United States Patent [19]

Den Besten et al.

[11] 4,201,421

[45] May 6, 1980

[54] MINING MACHINE BIT AND MOUNTING THEREOF

[76] Inventors: Leroy E. Den Besten, P.O. Box 344, Valatie, N.Y. 12184; James R. O'Connell, 9934 Aspen Ct., Mentor, Ohio 44060

[21] Appl. No.: 944,011

[22] Filed: Sep. 20, 1978

[51] Int. Cl.[2] ..... E21C 35/18

[52] U.S. Cl. ..... 299/86; 299/92; 37/142 R; 175/354

[58] Field of Search ..... 299/86, 92; 175/354; 403/165; 279/102, 103; 308/237 A, 8.2; 85/8.8; 37/142 R

[56] References Cited

U.S. PATENT DOCUMENTS

| | | | |
|---|---|---|---|
| 1,723,381 | 8/1929 | Seifert | 175/354 X |
| 3,397,012 | 8/1968 | Krekeler | 299/86 |
| 3,498,677 | 3/1970 | Morrow | 299/86 |
| 3,499,685 | 3/1970 | Kniff | 299/86 |
| 3,512,838 | 5/1970 | Kniff | 299/86 |
| 3,519,309 | 7/1970 | Engle et al. | 299/86 |
| 3,663,063 | 5/1972 | Johnmeyer | 299/86 |
| 3,752,515 | 8/1973 | Oaks et al. | 299/86 |
| 3,865,437 | 2/1975 | Crosby | 299/86 |
| 4,084,856 | 4/1978 | Emmerich et al. | 299/86 |

*Primary Examiner*—Ernest R. Purser

[57] ABSTRACT

In a mining machine which incorporates cylindrical cutting bits having conically shaped heads and located in sockets of bit holders, the cutting bits are retained within the sockets by split tubular spring sleeves. The split spring sleeves are located on the shanks of the bits and resiliently engage the inner surface of the sockets thereby securing the bit in the mount. The bit is free to rotate and the sleeve interposed between the socket and the bit prevents wear on those parts of the bit and mount.

22 Claims, 6 Drawing Figures

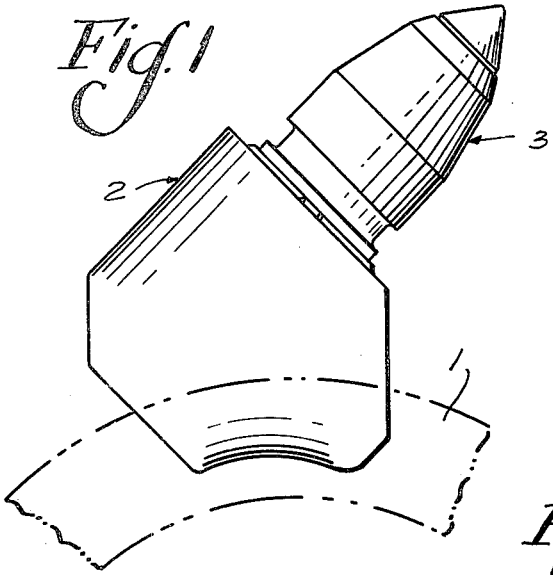
Fig. 1
2
3
1
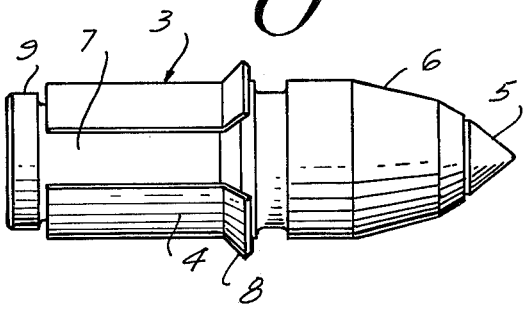
Fig. 2
9
7
3
6
5
4
8
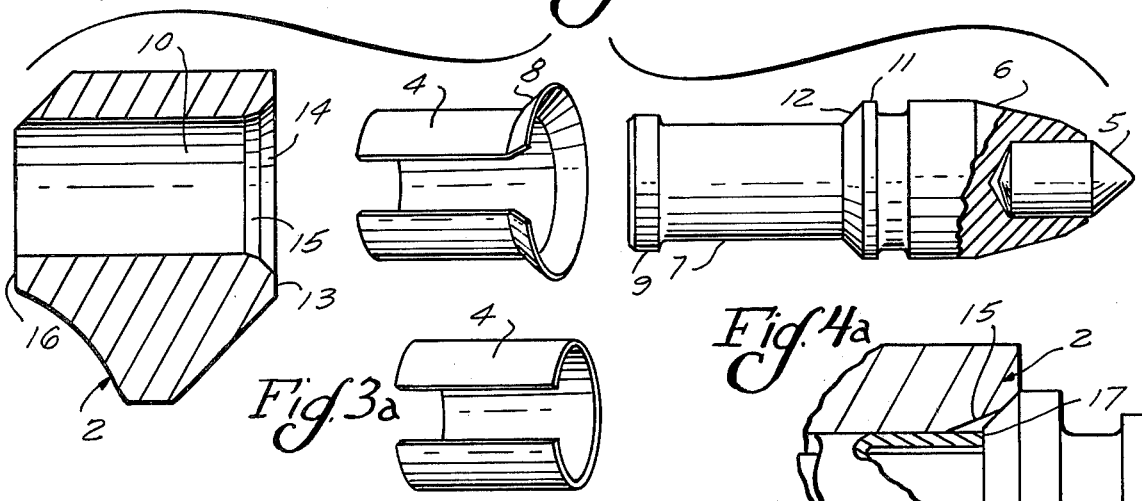
Fig. 3
10
14
15
13
16
2
4
8
12
11
6
5
9
7
Fig. 3a
4
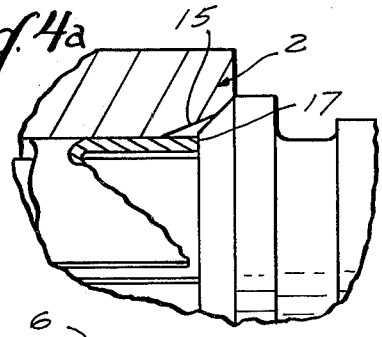
Fig. 4a
15
2
17
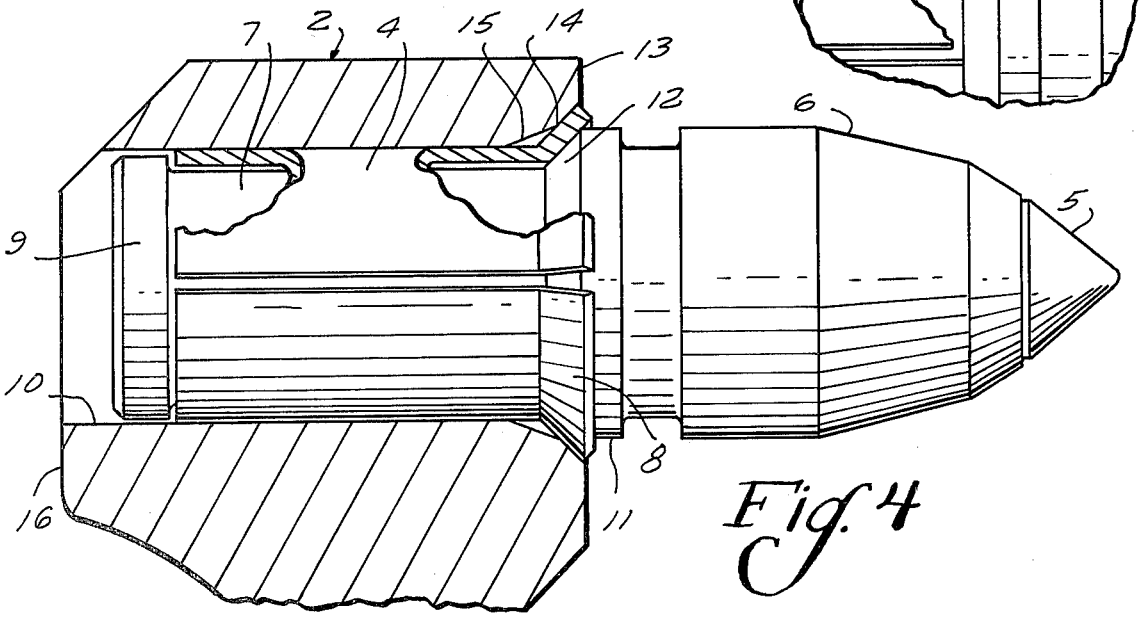
7
2
4
15
14
13
12
6
5
9
10
16
8
11
Fig. 4

MINING MACHINE BIT AND MOUNTING THEREOF

BACKGROUND OF THE INVENTION

1. Field of the Invention

The present invention is concerned with the structure and mounting of a mining bit of the type which comprises a cylindrical shank and a pointed working head adapted to be carried on the periphery of a mining machine wheel.

2. Description of the Prior Art

Mining machine bits having supporting shanks and operating heads of a generally conical shape with the apex of the head comprising an axially disposed point of a hard metallic carbide are known. They are generally utilized in mining machines having power driven cutter wheels. In these machines the power driven wheel is mounted on a horizontal shaft with the plane of the wheel disposed in a vertical plane. The wheel has on its periphery an array of cutter bits mounted on the rim of a wheel carried on a horizontal shaft, generally maintained in a horizontal position. The wheel comprises, on its periphery, a plurality of permanent mounting sockets adapted to hold pointed carbide tipped cutter bits which are mounted substantially tangentially on the peripheral rim of the supporting wheel so that through the rotation of the wheel about it's axis the bits may attack the material to be broken up by the horizontal reach of the teeth or cutter bits operating in a vertical plane.

In the course of operation of the machine, these bits engage and break up the surface in which they come in contact. Such machines are utilized in mining geological formations and in reducing large mineral deposits into pieces suitable for purpose and other similar applications.

While the machines are in operation, it is beneficial that the bits rotate freely in the sockets. This allows the wear upon the bit and the carbon insert to be distributed evenly allowing the bit to retain its symmetry thereby providing continuous sharpness of the bit and carbon insert in operation.

It is readily apparent that due to the nature of the work which the machine performs, the stresses on the machine are high and irregular. In addition, while the wear on the cutting portion of the bit is evenly incurred by allowing rotation of the bit, such rotation results in interaction between the bit and mount.

As a consequence of the foregoing the wearing down of the stem or shank of the bits, those portions within the mounts, and the mounts themselves becomes inevitable. This necessitates frequent replacement of the bits and eventually the mounts to maintain the efficiency of the machine.

Such replacement increases the expense of operating the machine due to the actual replacement of the worn parts and labor involved, but also due to the down time, or inoperability of the machine during such replacement.

SUMMARY OF THE INVENTION

It is an object of the invention to provide a mounting for the shank of a mining bit in the supporting socket of the mining wheel which will extend the life of the unit by reducing the stress and wear on the permanent parts of the bit and its mounting by providing a high strength steel sleeve between the shank of the bit and the inner wall of the socket.

Another object of the invention is to provide a mining machine with cutter bits mounted on the periphery of a mining wheel in such a fashion as to be readily removed and replaced at a relatively low cost keeping the machine in prime working condition with a minimum amount of down time.

A further object of the invention is to provide a high strength spring steel sleeve between the shank of the bit and the socket wherein the bit is allowed to rotate within the sleeve which is frictionally held on the inside wall of the socket while keeping the cutter bit in its working position on the rim of a wheel.

The present invention provides that a sleeve of cylindrical form with a slot extending the full length of sleeve be inserted along with the cutter bit, interposed essentially between the stem of the bit and the socket holding the bit located on the mining wheel. When worn out the bit and sleeve are expeditiously removed and replaced by simply forcing the bit and sleeve out of the socket and substituting a fresh bit unit by forcing it into the mounting socket. This may be readily accomplished by the use of a portable pneumatic or hydraulic cylinder unit. Further, because the sleeve is interposed between the bit and the socket the wear that usually results on the surface of the mount socket and the stem of the bit is reduced or eliminated. This insures the long life of the bit and mounting so that replacement is infrequent.

These and other objects and advantages may be obtained by the use of a spring steel sleeve in the mounting of the cutter bit.

BRIEF DESCRIPTION OF THE DRAWINGS

FIG. 1 is a perspective view of the cutting bit and mount therefor located on the periphery of a mining machine wheel;

FIG. 2 is a longitudinal view of the cutter bit incorporating the spring steel sleeve;

FIG. 3 is an exploded, partly sectional view of the mount, spring steel sleeve and cutter bit;

FIG. 3*a* is a longitudinal view of a straight, non-flanged steel spring sleeve;

FIG. 4 is a view, partially sectional, of a cutter bit incorporating a flanged spring steel sleeve located in a tubular bit holder or mount.

FIG. 4*a* is a fragmentary sectional view of the invention utilizing the spring steel sleeve shown in FIG. 3*a*.

DETAILED DESCRIPTION OF THE PREFERRED EMBODIMENTS OF THE INVENTION

In reference to FIG. 1, a bit supporting mount 2 is shown advantageously containing the spring steel sleeve and cutting bit 3 of this invention. The mount 2 is located on the periphery of a mining wheel 1.

Referring now to FIG. 2, the cutting bit 3 and sleeve 4 are shown separate from the mount 2. The bit 3 is generally short and includes a conically shaped head 6 and a cylindrical shank or stem 7. The conical head portion 6 of the bit is usually of a diameter which is greater than that of the shank 7, precluding the possibility of its being forced into the mount 2. Contained in the tip of the head 6 is a pointed insert 5. This insert is preferably made of a carbide metal, but may be made of any other material suitable for the purpose.

The stem of the bit is that portion of which is inserted in the mount. It is of a cylindrical shape and located about it is a spring steel sleeve 4. The sleeve is shown in its uncontracted disposition, usual prior to its insertion in the mount.

In regard to FIG. 3, an exploded view of the parts perspectively depicted in FIG. 1 is shown. The mount 2 for the bit 3 contains a cylindrical or tubular socket or bore 10. This socket may be located in the mining wheel 1 if so desired. The socket initiates at the front face 13 of the mount and may extend to its rear surface 16. The portion of the socket 10 located at the mounts front face 13 has a radially outward flanged surface 14. Adjacent to this surface 14 is an additional radially flanged surface 15.

The spring steel sleeve 4, shown in its uncontracted state, is longitudinally slotted and is preferably made of a resilient metal. The sleeve should have sufficient resilience when it is contracted to produce an adequate holding force for retaining it in its location when disposed in the socket 10. The sleeve may incorporate at one end a conically outwardly flared terminal margin or flange 8 or may be a straight throughout its length as shown in FIG. 3*a*. If a flanged sleeve is used it is preferable that it be integrally constructed for consistency of strength.

The shank or stem 7 of the bit terminates at its rear end in a radial flange 9 which fits slidably in the socket 10. The forward end of the stem abuts the head portion of the bit and at this junction is a radial shoulder 11 having a conical flange 12 which tapers inward toward the rear end of the stem. It is preferable that the shoulder 11 and flange 12 as well as the entire bit be constructed as a single piece.

When the bit is inserted into the mount it is done so with the sleeve 4, located between the rear flange 9 and forward flange 12, loosely enbracing the stem as depicted in FIG. 2. As such, the insertion of the bit and sleeve takes place contemporaneously and is accomplished through the use of axial force in the direction of the socket. The sleeve initially engages the flared conical surface 14 which is at a low angle to the longitudinal axis of the bit. The surface 14 guides the entry of the spring sleeve into the socket thereby assisting in the first stage of contraction of the circumference of the sleeve. Upon further insertion, the adjacent conical surface 15, at a smaller angle to the stems axis than surface 14, serves to further contract the sleeves circumference to a point when the sleeve is readily capable of sliding into the remaining portion of the socket. Continued application of axial force completes the insertion of the bit and sleeve in the mount.

With regard to FIG. 4, the bit 3 with a sleeve 4 and flange 8 is shown fully inserted in the socket 10 of the mount. The cutter bit and mount are ready to be used for the desired function. The spring steel sleeve loosely embraces the stem of the bit while resiliently engaging the inside of the surrounding cylindrical surface of the socket 10. The conical flange 8 of the sleeve is positioned between the conical surface 14 of the mount and the conical flange 12 of the shoulder 11. The spring sleeve exerts a strong hold on the inner surface of the socket and resists endwise movement out of it. The engagement of flange 9 with the sleeve 4 retains the embraced bit in the socket during the normal operation of the machine. The flange 8 of the sleeve rests against the conical surface 14 of the socket. While previously this surface 14 assisted in the contraction of the circumference of the sleeve, it now provides a bearing surface for receiving and distributing the pressure on the bit. During operation, the endwise axial pressure on the bit keeps the bit in the seat provided by flange 14.

Additionally, because the bit is loosely embraced by the sleeve, the bit is allowed to rotate, providing for even wear upon its surface thereby prolonging its useful life.

The spring sleeve acts as a buffer between the bit and the mount absorbing any wear that might result on the socket surface 10 or the bit by rotation of the bit or any other interaction between the bit and the mount. Also, since there is no substantial force tending to pull the sleeve and the bit out of the socket the retaining force of the spring steel sleeve is at a minimum providing for easy extraction when replacement becomes necessary. Because the flange 9 engages the rear end of the sleeve, extraction of the bit necessarily extracts the sleeve adding to the simplicity of such operation.

Similar results may be obtained by the use of a straight or flangeless spring steel sleeve as depicted in FIG. 3*a*. Slight modifications of the design of the bit 3, however, may be desirable. As shown, in FIG. 4*a* the sleeve 4 is similarly disposed on the stem 7 of the bit. This embodiment of the invention provides that a radially perpendicular surface to the stems axis or lip 17 be located on the shoulder 11. This would engage the sleeve 4 and would provide transmittal of axial force upon the circumference of the sleeve during its insertion. Additionally if it is desired to keep the surface 14 of the socket 10 at the same diameter as that where a flanged spring sleeve is used the invention contemplates that the shoudler 11 and flange 12 be increased in its diameter so that the flange 12 bears directly on the conical surface 14, thereby providing a seating for the same during the machines operation.

Although the somewhat preferred embodiments have been disclosed and described in detail herein, it should be understood that this invention is in no sense limited thereby and its scope is to be determined by that of the appended claims.

Furthermore, while a mining bit has been specifically described, other applications of the invention for breaking up natural and artifical structures, surfaces and formations will be evident.

What is claimed is:

1. The combination in a mining wheel having an axis of rotation with said wheel having a peripheral rim, a series of bit holders in the form of tubular sockets mounted on the rim of the wheel for supporting mining bits, mining bits mounted in said bit holders, said sockets each having at its front end a substantially conical rim, mining bits each having a shank of generally cylindrical form and having conical heads and having cylindrical stems of a diameter smaller than the diameter of the bit heads, said bits supported in said sockets and extending radially and angularly forwardly with respect to the aforesaid sockets and incline forwardly in a direction of rotation of the wheel, said mining bits each having a split tubular spring sleeve having an unstressed diameter greater than the diameter of the sleeve when it is disposed in the socket with the latter diameter greater than that of the diameter of the shank adjacent the sleeve when said sleeve is disposed on the shank so as to allow rotation of the shank in the sleeve, each sleeve is adapted to expand radially relative to the shank of the associated bit and to abut endwise against a retaining means on the rear end of the shank of the bit, said tubular sockets receive the shank of the bit and the cylindrical portion of the spring sleeve for retaining the shank of the bit against longitudinal outward movement of the bit shank, a retaining means at the front end of the shank, said sleeves being mounted on substantially all of the shank of the bit intermediate the retaining means, said sleeves being non-rotational in said sockets and interposed between the shanks of their respective bits and the sockets so as to accept substantially all of the wear on the socket resulting from interaction as between the shanks and the sockets during operation of the wheel with the exception of the wear that might result from interaction of the retaining means with the socket.

2. The combination of claim 1 wherein the shank of each bit has a conical shoulder which acts as the front retaining means and being engageable with the conical rim of the socket.

3. The combination of claim 2 wherein the split tubular spring sleeve is flared out conically to form a conical flange for engaging the conical shoulder of said bit, said flange being interposed between said shoulder and the conical rim of the socket so as to accept wear resulting from interaction as between the shoulder and rim during operation of the wheel.

4. The combination of claim 3 wherein the spring sleeve comprises an integral conical outwardly flared flange at its forward end, said flanged sleeve may be mounted on the cylindrical shank of the bit and forced into the bore of the socket member whereby the conical flange of the sleeve lies between the conical rim of the socket and the conical shoulder of the bit.

5. The combination according to claim 1 wherein the spring sleeve is forced endwise into the bore in the support socket.

6. The combination of claim 1 wherein the retaining means on the front and rear end of the bit's shank are radial flanges having a sliding fit with the support socket.

7. The combination according to claim 1 wherein said sockets comprise an open ended cylindrical bore with a conical surface at its front end, its longitudinal axis being disposed at an acute angle to the longitudinal axis of the bore.

8. The combination of claim 7 wherein the bore of the socket member comprises two intersection conical surfaces at the front end of the socket member to facilitate contraction of the spring sleeve by endwise pressure on the opposite end of the sleeve.

9. The combination in a mining wheel having a series of bit holding sockets on the wheel with said sockets lying in a plane of the wheel and on the outer periphery of the wheel, conically pointed and generally cylindrical bits having bit heads and shanks disposed in said sockets with each shank having retaining means at the front and rear of the shank, split cylindrical spring sleeves disposed between the sockets and the shanks of the bits, said sleeves having an unstressed diameter greater than the diameter of the sleeve when it is disposed in the socket with the latter diameter greater than that of the diameter of the shank adjacent the sleeve when said sleeve is disposed on the shank so as to allow rotation of the shank in the sleeve, said sleeve adapted to expand radially relatively to the shank and to abut endwise against the rear retaining means thereby holding the shanks of the bit in the sockets, said sleeves being non-rotational in said sockets and each being located on substantially all of each respective shank between the front and rear retaining means, and said sleeves are adapted to accept substantially all of the wear on the socket resulting from interaction as between the shanks and the sockets with the exception as to the wear that might result from interaction of the retaining means and the socket.

10. The combination of claim 9 wherein the outermost end of the socket comprises two degrees of angularity with the forward end of the socket terminating in a conical surface of greater angularity than the adjacent conical surface of a lower degree of angularity.

11. The invention in accordance with claim 9 wherein said retaining means are radial flanges.

12. In combination with a mining machine having a cylindrical socket open at both ends, the outer margin of the socket being flared out in a conical form in combination with a mining bit having a cylindrical shank terminating at its rear end in a retaining means and joined at its front end to a conical head of larger diameter than that of the shank, the bit and the shank being joined by a conical wall between the head and the shank of the bit, said wall tapering inwardly towards the rear end of the shank, the bit having an annular shoulder formed by a groove adjacent the junction of the shank and the head of the bit, a split cylindrical spring sleeve embracing substantially all of the shank of the bit between the rear retaining means and the conical wall with said sleeve having an unstressed diameter greater than the diameter of the sleeve when it is disposed in the socket with the latter diameter greater than that of the diameter of the shank adjacent the sleeve when the sleeve is disposed on the shank so as to allow rotation of the shank in the sleeve, said sleeve being biased to exert radially outward pressure against the walls of the socket in which the shank of the bit is located retaining said bit, and said sleeve being non-rotational in said socket and interposed between the shank of the bit and the sockets so as to accept substantially all of the wear on the socket resulting from interaction as between the shank and the socket with the exception of the wear that might result from interaction of the retaining means and the conical wall with the socket.

13. In combination with claim 12 wherein the front end of the socket member facing toward the front of the pointed end of the bit has two different adjacent conical surfaces of different degrees of taper, the outermost one of these conical surfaces having a steeper inclination towards the axis of the cylindrical socket than does the adjacent conical surface, whereby the sleeve surrounding the shank of the bit is facilitated in its introduction into the cylindrical bore under tension.

14. The invention in accordance with claim 12 wherein said retaining means is a radial flange.

15. In combination with a mining wheel bit socket, a conical pointed bit having a cylindrical shank terminating at its front and rear end in retaining means, a split cylindrical spring sleeve being adapted to be forced endwise over the rear end of the shank and at its forward end engages the front retaining means permitting the sleeve to embrace substantially all of the shank of the bit between the front and rear retaining means and to bear endwise against said retaining means at the rear end of the shank, said sleeve having an unstressed diameter greater than the diameter of the sleeve when it is disposed in the socket with the latter diameter greater than that of the diameter of the shank adjacent the sleeve when said sleeve is disposed on the shank so as to allow rotation of the shank in the sleeve, said sleeve is adapted to expand radially relative to the shank and to abut endwise against the rear retaining means whereby the shank of the bit is retained in the cylindrical tubular socket in which it is mounted, said sleeve being non-rotational in said socket and interposed between the shank of the bit and the socket over substantially all of the shank so as to accept substantially all of the wear on the socket resulting from interaction as between the shank and the socket with the exception of the wear that might result from interaction of the retaining means with the socket.

16. A cutting bit having a shank with a forward end and a rear end, a tip adjacent the forward end for expediting the cutting action, a front and rear retaining means located at the forward and rear end of the shank respectively, a sleeve mounted on substantially all of the shank of the bit intermediate the front and rear retaining means and abutting said rear retaining means, a mounting means, said sleeve having an unstressed diameter greater than the diameter of the sleeve when it is disposed in the mounting means with the latter diameter greater than that of the diameter of the shank adjacent the sleeve when said sleeve is disposed on the shank so as to allow rotation of the shank in the sleeve, said sleeve is adapted to expand radially relative to the shank and abut endwise against the rear retaining means thereby retaining said bit in the mounting means, said mounting means provides for rotatably mounting the bit providing relative rotation between the sleeve and the bit whereby the bit is adapted to freely rotate within the mounting means and the sleeve is non-rotational in said mounting means and adapted to accept substantially all of the wear on the mounting means resulting from interaction as between the shank and the mounting means with the exception of wear that might result from interaction of the retaining means and the mounting means.

17. The invention in accordance with claim 16 in which said mounting means is a cylindrical tubular socket.

18. The invention in accordance with claim 17 wherein said socket is located upon a wheel.

19. The invention in accordance with claims 15 or 16 wherein said retaining means are radial flanges.

20. For use in a mining machine device having tubular cylindrical sockets, a pointed bit having a cylindrical shank terminating at its front and rear end in retaining means and a cylindrical sleeve rotatably located on substantially all of said shank between the front and rear retaining means, said sleeve having an unstressed diameter greater than the diameter of the sleeve when it is disposed in a socket with the latter diameter greater than that of the diameter of the shank adjacent the sleeve when said sleeve is disposed on the shank so as to allow rotation of the shank in the sleeve, the sleeve being adapted to expand radially relative to the shank of the bit and to abut endwise against the retaining means on the rear end of the shank of the bit retaining the shank of the bit against longitudinal outward movement from the socket when the bit is disposed in said socket, wherein when said bit with sleeve is placed in the socket said sleeve is non-rotational in said socket while allowing rotation of the bit in the socket and accepts substantially all of the wear on the socket resulting from interaction as between the shank and the socket with the exception of the wear that might result from the interaction of the retaining means with the socket.

21. The invention in accordance with claim 20 wherein said retaining means are radial flanges.

22. The bit in accordance with claim 21 wherein the radial flange on the front end of the shank is conical and the cylindrical sleeve has a conically flared front to facilitate assembly of the sleeve on the shank and to serve, after the sleeve is disposed in the socket, between the conical flange on the shank and the socket as a wear sustaining flange.

* * * * *